US007104938B1

(12) United States Patent
Smith

(10) Patent No.: US 7,104,938 B1
(45) Date of Patent: Sep. 12, 2006

(54) HOLISTIC EXERCISE DEVICE

(76) Inventor: Robert Samuel Smith, 1263 Emorg St., San Jose, CA (US) 95126

( * ) Notice: Subject to any disclaimer, the term of this patent is extended or adjusted under 35 U.S.C. 154(b) by 0 days.

(21) Appl. No.: 10/437,739

(22) Filed: May 14, 2003

(51) Int. Cl.
*A63B 26/00* (2006.01)

(52) U.S. Cl. ..... 482/142; 482/104; 482/106; 482/92

(58) Field of Classification Search ..... 482/142, 482/104, 106, 92–94; D21/676, 689, 6
See application file for complete search history.

(56) References Cited

U.S. PATENT DOCUMENTS 5,050,868 A * 9/1991 Pearson ..... 482/94
5,050,872 A * 9/1991 Farenholtz ..... 482/133
5,310,394 A * 5/1994 Kallios ..... 482/104
5,813,951 A * 9/1998 Einsig ..... 482/97
6,561,957 B1 * 5/2003 Read ..... 482/94
2002/0098953 A1 * 7/2002 Scheewe et al. ..... 482/94
2004/0023761 A1 * 2/2004 Emery ..... 482/94

* cited by examiner

*Primary Examiner*—Lori Amerson
(74) *Attorney, Agent, or Firm*—Robert Samuel Smith

(57) ABSTRACT

An exercise apparatus including a frame of four vertical legs secured together by horizontal rails on two opposing sides and an H frame telescoping into top ends of respective legs on one end of the frame. A floor platform has one end hingeably attached to bottom ends of two adjacent legs and extends between and beyond the two other legs. A barbell is clamped at a selectable location on the horizontal rails for providing resistance to performing deadlifts and leg presses by standing on the platform and lifting one end of the platform. Handles are detachably attachable to various locations on the frame. Uprights are provided for dips and pullups. A speed controller is provided for super slow repetitions.

23 Claims, 11 Drawing Sheets

HOLISTIC EXERCISE DEVICE

FIELD OF THE INVENTION

This invention relates to exercise apparatus and particularly to an apparatus that enables a user to perform a long list of unique exercises for the whole body.

BACKGROUND AND INFORMATION DISCLOSURE

Exercise apparatus are available in many forms and are generally adapted to performing a limited number of exercises. For example, the slant board is used for performing situps. The horizontal bar is adapted to performing pullups.

Some apparatus are described as being "Universal" in the sense that a number of different exercises can be performed with the apparatus. "UNIVERSAL™ exerciser is one example of such an apparatus. Another example is the "IRONMASTER™ exerciser" which is a combination self spotting machine and bench for leg exercises.

In the context of the following paragraphs, the term "isolate on a muscle group means that, in performing a given exercise, one particular muscle group is taxed to its maximum capabilities that that muscle group becomes the limiting group in performing the exercise.

None of these exercisers enable a user to adapt a "holistic program"addressed to specific individual needs.

SUMMARY OF THE INVENTION

It is an object of this invention to provide an apparatus that enables a user to design a program directed to his specific needs.

One group of exercises are directed toward isolating on anyone of the muscle groups that are used in sprinting. These muscle groups include, the glutes, hamstrings, quadriceps, hip flexors, hip extensors. The requirement here is to stress the muscle to its maximum capacity without injury. Stressing to maximum capacity provides maximum rate of strength increase.

Another group of exercises is directed to strengthening the upper body. These exercises include not only curls, bench presses, vertical rowing, etc. but also exercises that help an athlete to "handle" his body and include dips and pullups. An important feature of the apparatus is that adjustments are provided which accommodate the users size to the apparatus.

Another group of exercises is directed to developing explosive strength such as required for the vertical leap or performance in many sports.

An important feature of the apparatus is the ability to change the resistance of the exercise very conveniently and quickly without requiring exchanging a number of plates.

The invention is directed toward a basic frame which is similar to a table that has no table top. The frame s described herein as having a pair of front frame legs and a pair of rear frame legs. Each front frame leg is attached to a respective rear frame leg by an upper rail and a lower rail.

The upper end of each front frame leg is secured to the upper end of the neighboring front frame leg by a cross bar whose each end is perpendicularly joined to a stud bar that telescopes into the open end of the respective front frame leg.

The lower end of each rear frame leg is hingeably pinned to a cross floor bar that is attached by a floor bar to a floor platform located on the floor between the legs of the frame. The four legs of the frame are thereby secured together to provide a stable structure.

A barbell is clamped onto the lower rails at a location selected to provide required resistance for performing the exercise.

The user performs one legged deadlifts and leg presses by placing one foot on the platform and grasping in both hands a pair of quick release handle bars having ends that are detachably attached at selected vertical locations on the front legs.

In one mode, the handle bars are parallel to the horizontal center-line of the frame permitting the user to lift the front legs of the frame to perform one legged dead lifts.

In another mode, the handles are perpendicular to the horizontal center line permitting the user to sit on the handle bars and perform one leg presses.

The vertical location of each handlebar on its respective leg is selected by disengaging a popit pin and sliding the end of the handle bar on the vertical leg.

An "upper body " bar has each end attached by adjustable length chain to a respective handle bar. The user is thereby enabled to stand on the platform and perform curls, military presses, vertical rows, etc.

Resistance to performing the deadlift or leg press (as well as many other exercises} is adjustable by a barbell that is positionable on the lower rails as described above.

A seat is supported in any one of selected locations on the upper rails. In one mode the seat is stationery at its location on the rails In another mode, practiced by simply shifting the seat support, The seat rolls on the top rails for performing rowing exercise. The resistance to rowing is adjustable and features a fast return.

A hinged extension arm is attachable to the seat enabling the user to be supported on the seat and perform leg curls and knee extensions.

Each one of a pair of removable pullup legs has a lower end telescoped into the open top of a respective rear frame leg. Each pullup leg is secured at a selected vertical location by a popit pin. Each pullup leg has a horizontal pullup handle that slides through an opening in the top end of the respective pullup leg.

In order to perform pullups, the user raises the pullup handle to an extended over head location. The pullup handles are slid toward one another for performing the pullups.

In order to perform dips, the user lowers the pullup legs and separates the ends of the pullup handle bar to where he can stand between the ends of the dip handles. He performs the dips by grasping each dip handle and pushes to lift himself vertically by straightening his arms.

An exercise that develops explosive strength is performed with a jump platform that is laid across the two handles, one handle on each vertical leg of the apparatus at a selected vertical location. Changes in the vertical location of the platform are accomplished by shifting the handles on the front legs.

The user stands by the rear legs and jumps up on the platform. If he desires, he can grasp a pullup leg in each hand to help him maintain balance and confidence. Then he leaps up on the platform, then back onto the floor and repeats this action according to his desires. As his jumping ability improves he places the platform at higher and higher locations in 1½ inch increments.

Exercise routines may be separated into two categories—super slow for developing isometric strength and plyometric for developing explosive strength. Athleticism generally requires a degree of both kinds.

A plyometric exercise is performed by performing a quick negative contraction before beginning the positive contraction.

For example, to develop explosive strength in the gluteus, the athlete stands on two legs, grasps the handles of the apparatus and straightens up, thereby lifting the front legs of the apparatus (as if he were lifting a wheelbarrow, Then he supports himself on one leg as he bends over so that the chest approaches his knee. He bends over as quickly as possible until the weight has almost returned to the ground (reverse contraction mode) then he lifts the weight again by straightening his one leg (the positive contraction. The stretch (initial negative contraction) introduces a stretch reaction that strengthens the positive contraction.

The present apparatus is especially well; suited for this type of exercise because of the convenience in performing the negative contraction preceding the positive contraction, and because the position of the weight on the apparatus multiplies the rate of free fall. Therefore the rate of stretch is very much increased which s beneficial for generating the stretch reflex.

Another mode of exercise that is effective in building isometric strength and bulk is popularly known as "superslow" exercise. This type of exercise is just the opposite of Plyometric exercise. Super Slow exercise routine is where a single repetition is performed VERY SLOWLY.

SuperSlow Exercises are performed as a feature of this invention by attaching to the frame of the apparatus a device that permits the athlete to perform a repetition at a slow controlled speed wherein the apparatus improves as long as the athlete pushes (or pulls) with a force that exceeds a preset value.

DESCRIPTION OF BEST MODE

Figure 1:
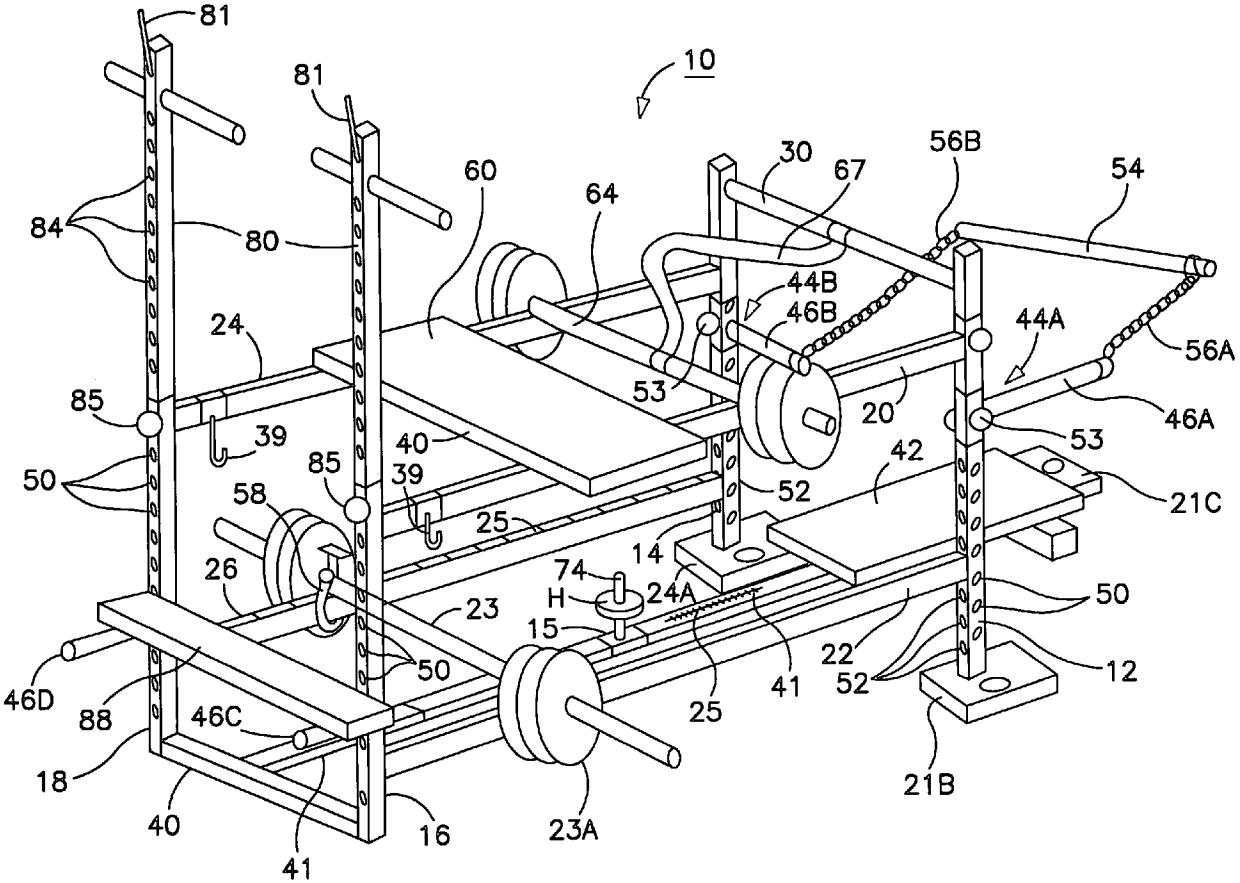
FIG. 1 shows the assembled invention.

Turning now to a discussion of the drawings FIG. 1 shows a frame including two vertical front legs 12 and 14 and two vertical rear legs 16 and 18.

Figure 2:
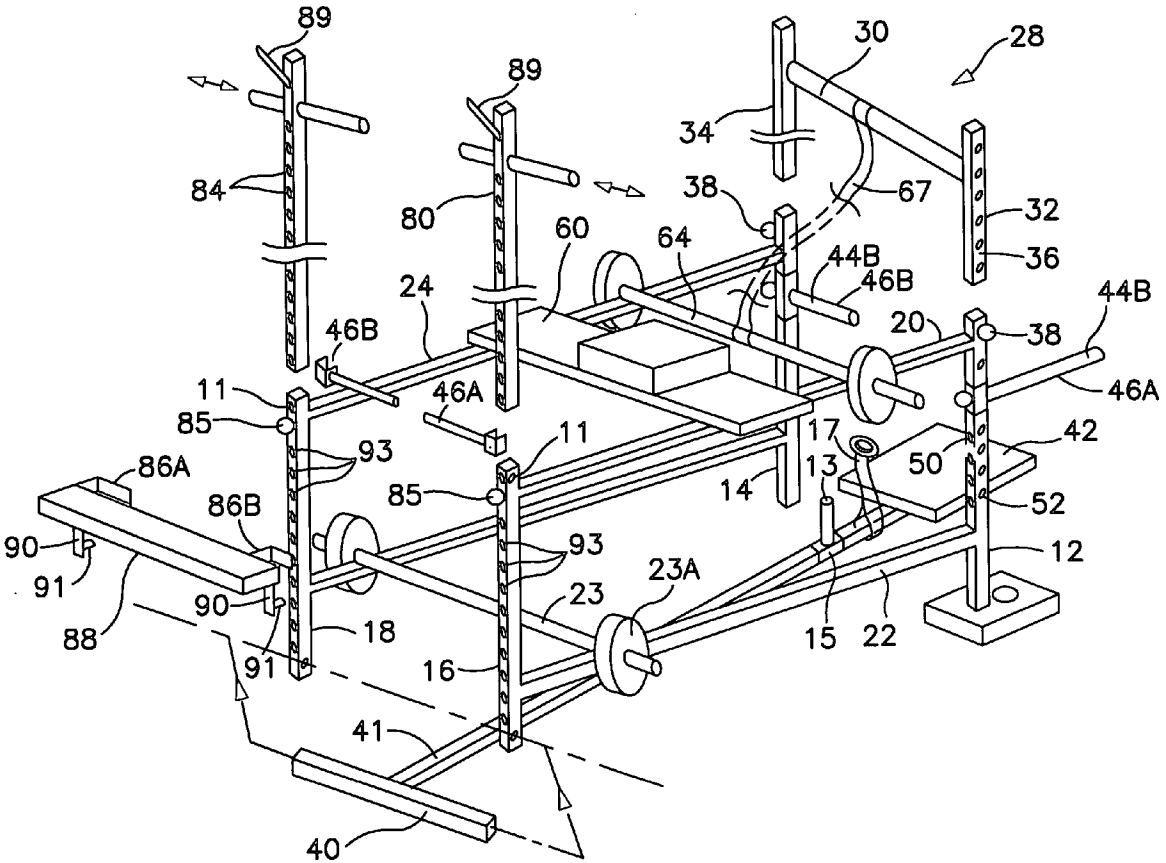
FIG. 2 is an exploded view of FIG. 1.

FIG. 2 is an exploded view of FIG. 1.

Front leg 12 is joined to rear leg 16 by a horizontal upper rail 20 and a horizontal lower rail 22.

Front leg 14 is joined to rear leg 18 by horizontal upper rail 24 and horizontal lower rail 26.

The legs 12–18 comprise square tube with open tops.

FIG. 2 shows, to best advantage, details of an H frame 28 including a cross bar 30 having an end perpendicularly attached to stud bar 32 and another end perpendicularly attached to stud bar 34. The stud bar 32 is telescoped into the top end of front leg 12 and stud bar 34 is telescoped into the top end of front leg 16. A spring loaded popit pin 38 in the upper ends of front legs 12, and 16 engage apertures in the stud bars 32 and 34 and permit that the vertical distance of the cross bar 30 from the ground is selectable.

One end of a cross floor bar 40 is hingeably attached to the bottom end of rear leg 16 and The other end of cross floor bar 40 is hingeably attached to the bottom end of rear leg 18.

One end of a floor bar 41 is secured to the middle of cross floor bar 40. The other end of floor bar 41 extends horizontally to between and beyond the front legs. 12 and 14. A platform 42 is removably attached to the extended end of floor bar 41.

Figure 3:
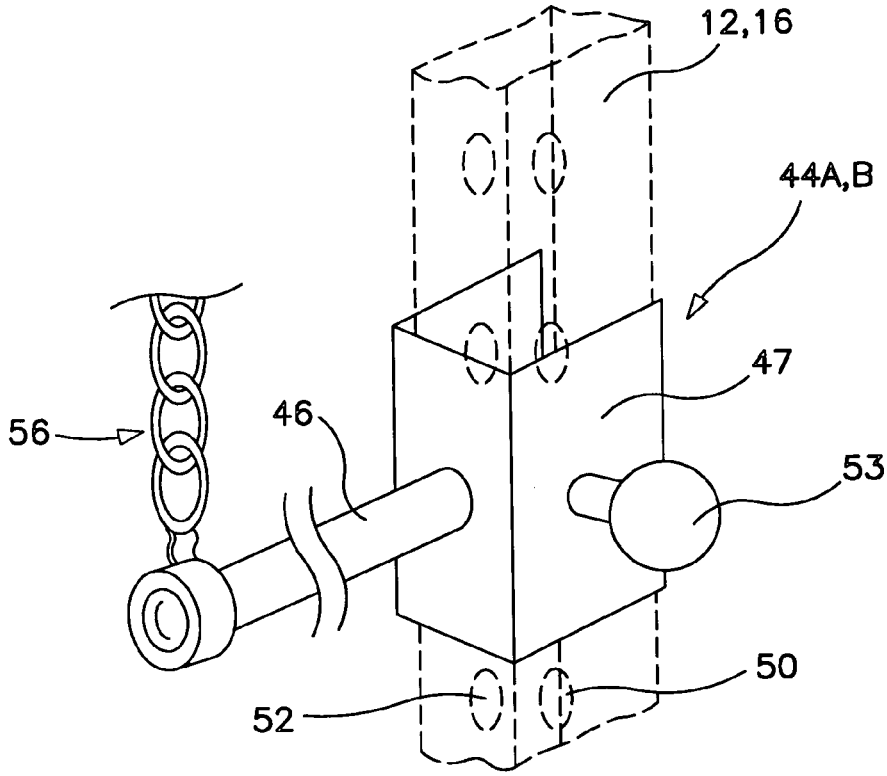
FIG. 3 shows details of the lift handles.

A pair of handles 44A, 44B are shown detachably attached to front leg 12, 14 respectively. Details of each handle 44 are shown in FIG. 3 and include a channel 47 that mounts slideably but snugly onto the respective front leg 12, 14. One end of a handle bar 46 is perpendicularly secured to a channel 47. Each front leg 12, 14 has a "front" row of apertures 50 on one side of the front leg 12, 14, and a "side" row of apertures 52 on an adjacent side (Front row apertures 50 are not visble in FIG. 1, 2.) A spring loaded "popit" pin 53 mounted on each channel 47 engages one of apertures 50, 52 so as to secure the handle at a selected vertical location.

When the popit pin 53 engages a "front" aperture 50, the handle bar is parallel to the floor bar 42 as shown by handlebar 46A in FIG. 1 to perform deadlifts.

When the popit pin 53 engages a "side" aperture 52, the handle bar is perpendicular to the floor bar 41 as shown by handlebar 46B to perform leg presses.

To perform dead lifts, the handle bars 46 are parallel to floor bar 41 (See 46A in FIG. 2)). The user stands on the platform 42 facing the apparatus, grasps the handles 44, and lifts the end of the apparatus.

To perform leg presses, the handle bars 46A,B point toward one another extending almost entirely across the space between the front legs 12, 16. The users sits on the handle bars 46 with his back toward the apparatus (See 46B in FIG. 2.) He grasps the handles 44 and with the cross bar 30 against his shoulders, he lifts the end of the apparatus by straightening his knee.

FIG. 1 shows means for resistance to lifting the front end of the apparatus is provided by a barbell 23 (with weights) supported on the two lower rails 22, 26. The resistance is selected by rolling the barbell 23 on the lower rails 22, 26 to a position indicated by a scale 25 on rail 26 corresponding to the required resistance.

Figure 4:
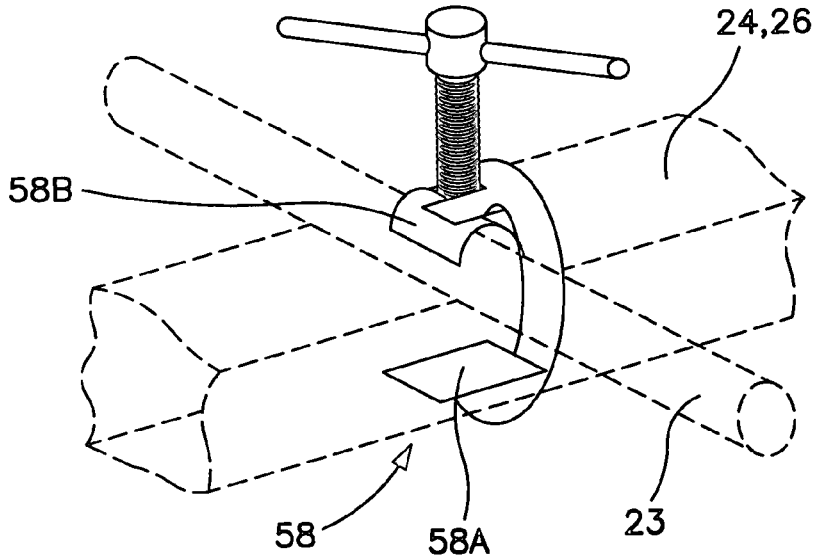
FIG. 4 shows a clamp for securing the barbell at selected locations.

Once the weight bar is rolled to the desired location on scale 25, the bar 23 is clamped to the rails by quick release clamps 58. Details of the clamp 58 are shown in FIG. 4. The clamp is basically a C-clamp one of whose jaws 58A is flat and the other jaw 58B is a hemicylinder for effective clamping action against the bar 23.

The method and arrangement for changing resistance is a major advantage for using the apparatus since resistance can be changed from a minimum of 50 pounds when the barbell 23 is positioned at the rear end of rails 24, 26 to hundreds of pounds when the bar 23 is rolled to the other end of the lower rails 22, 26.

FIG. 1 shows an exercise bar 54 one of whose ends is attached by chain 56A to the free end of one handle bar 46 A and by chain 56 B to the free end of the other handle bar 46B. The length of chains 56 A,B and the position of the handles 46A,B on the respective front legs 12, 14 are selected according to the size of the user. To perform upperbody exercises (curls, military presses, vertical rows, etc) The user stands on the platform 42, grasps the tethered bar 54 and lifts the end of the apparatus 10. For these upperbody exercises (where lighter resistance is required), the weight bar 23 is located close to the rear end of the lower rails 22, 26.

The exercise bar 54 offers a very important feature to the athlete training to condition his proprioceptors (improve his balance). Namely, when a weight is suspended on the end of a chain whose other end is attached to a bar, (the bar grasped by the athlete) there is negligible inertia in any horizontal direction of motion of the bar. Accordingly, a heightened sense of balance is required to perform the exercises discussed above and additionally to perform lower body exercises. The required heightened sense of balance, as hereby claimed for the use of this feature, is very effective in conditioning the proprioceptors (improving balance agility, etc.)

Figure 5A:
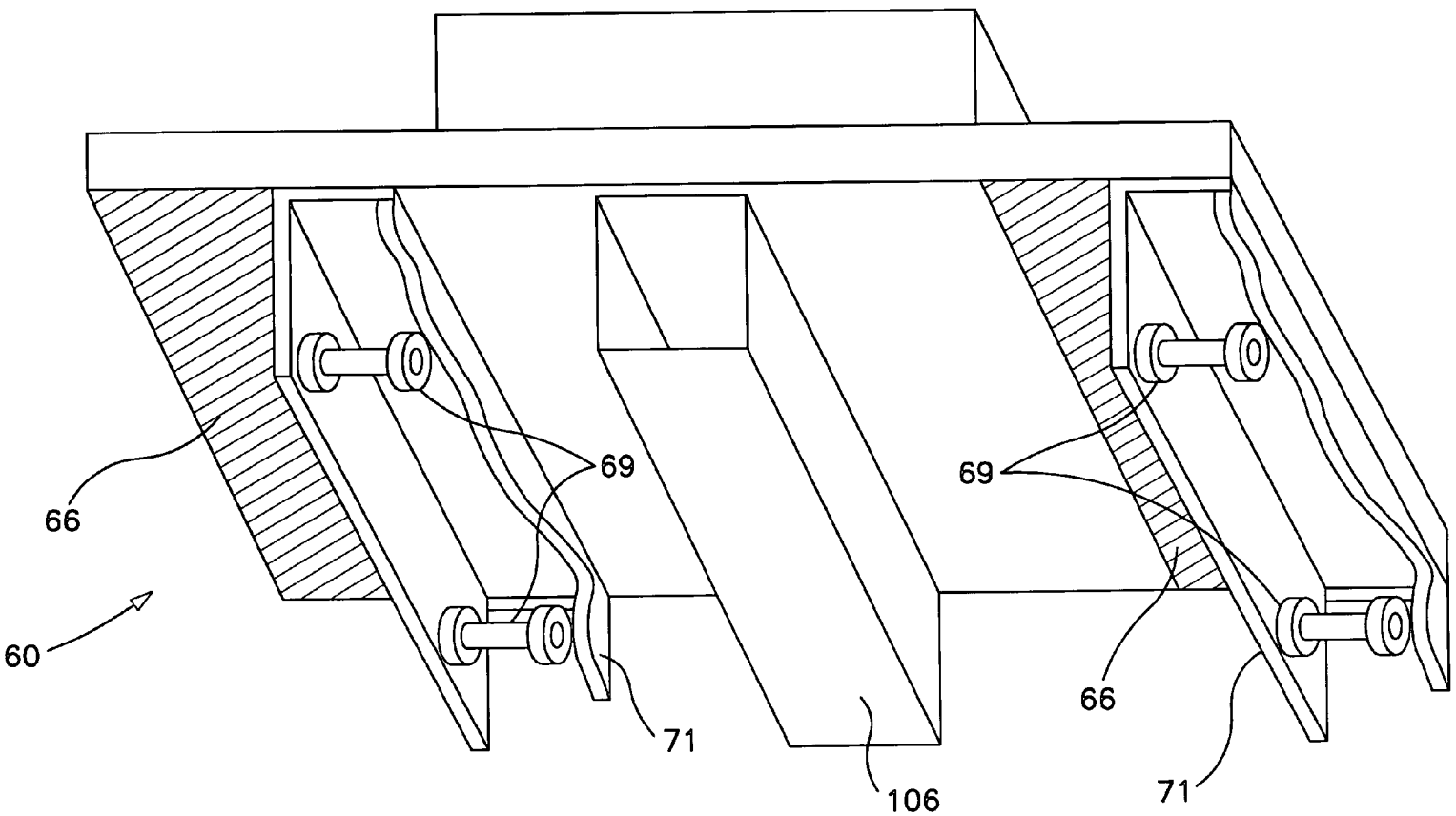
FIGS. 5A,B show details of the seat.
Figure 5B:
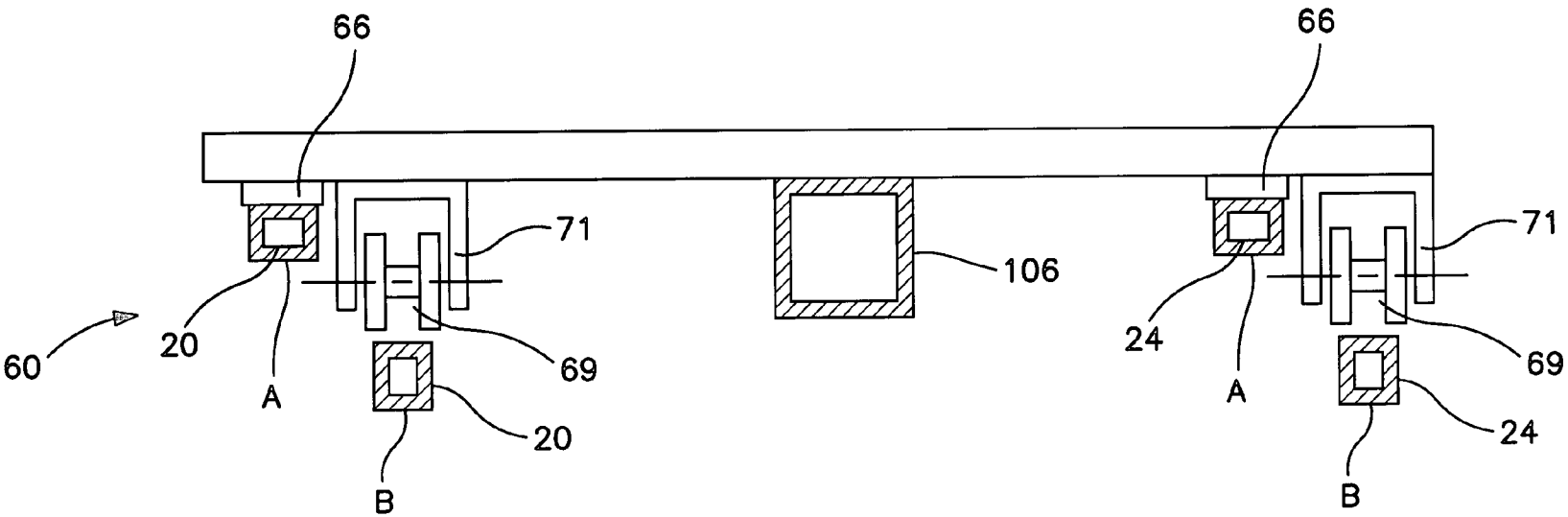
FIG. 5C shows the arrangement for performing the rowing exercise.

FIG. 5 A, B shows details of a seat 60 supported on the top rails 20 and 24 in FIG. 1. The athlete selects either one of two areas of seat 60 for supporting the seat 60 on rails 20, 24. One area of support 66 is a laminated corrugated rubber surface (non-slip) on the bottom side of the seat 60 that (for certain exercises) lies directly on rails 20, 24. The rails 20, 24 are shown in position A on rails 20,24 in FIG. 5B. The seat 60 will not slip in this stationary mode of support and is positioned for situps, back extensions and abdominal crunches).

FIG. 5A shows a bearing support 69 for supporting the seat 60 in another position to roll on top rails 20, 24. This is shown in FIG. 5B where bearngs 69 roll on rails 20, 24. The bearings are mounted in a channel 71 shown partially cutaway in FIG. 5A. The seat is supported in the rolling mode for performing the aerobic rowing exercise.

Figure 5C:
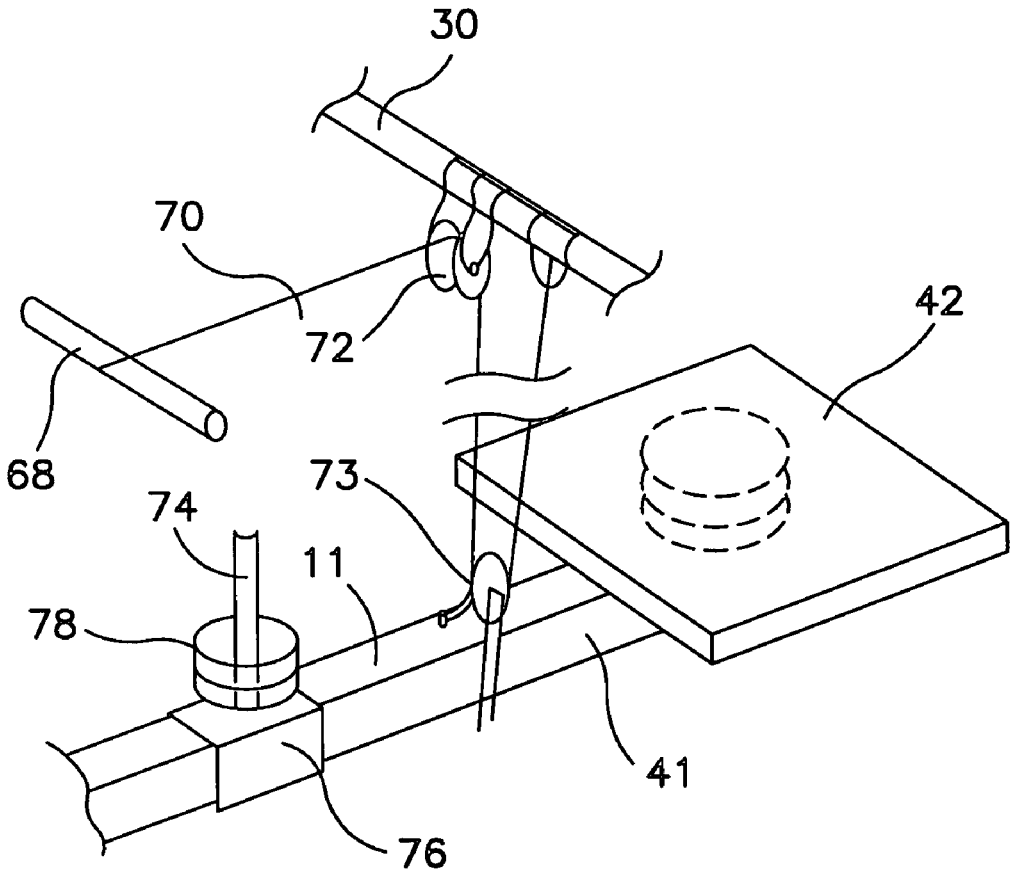

FIG. 5C shows the arrangement for sitting on the rolling seat and rowing (The seat is not shown in FIG. 5C). The row handle 68 is attached to one end of a row strap 70 which passes over a bearing 72 slid onto the center of the cross bar 30. The other end of the row strap 70 passes around a pulley 73 mounted on the floor bar 41 and back to where it is fastened to the cross bar 30. A stack of row weights 78 on a post 74 mounted on a channel 76 provides resistance to performing the rowing exercise. The magnitude of the resistance depends on the amount of row weight 78 and the location of the row weight 78 on floor bar 41. The adjustable position of the row weight on the floor bar 41 determines the speed of return of the seat in performing the rowing exercise.

Figure 6:
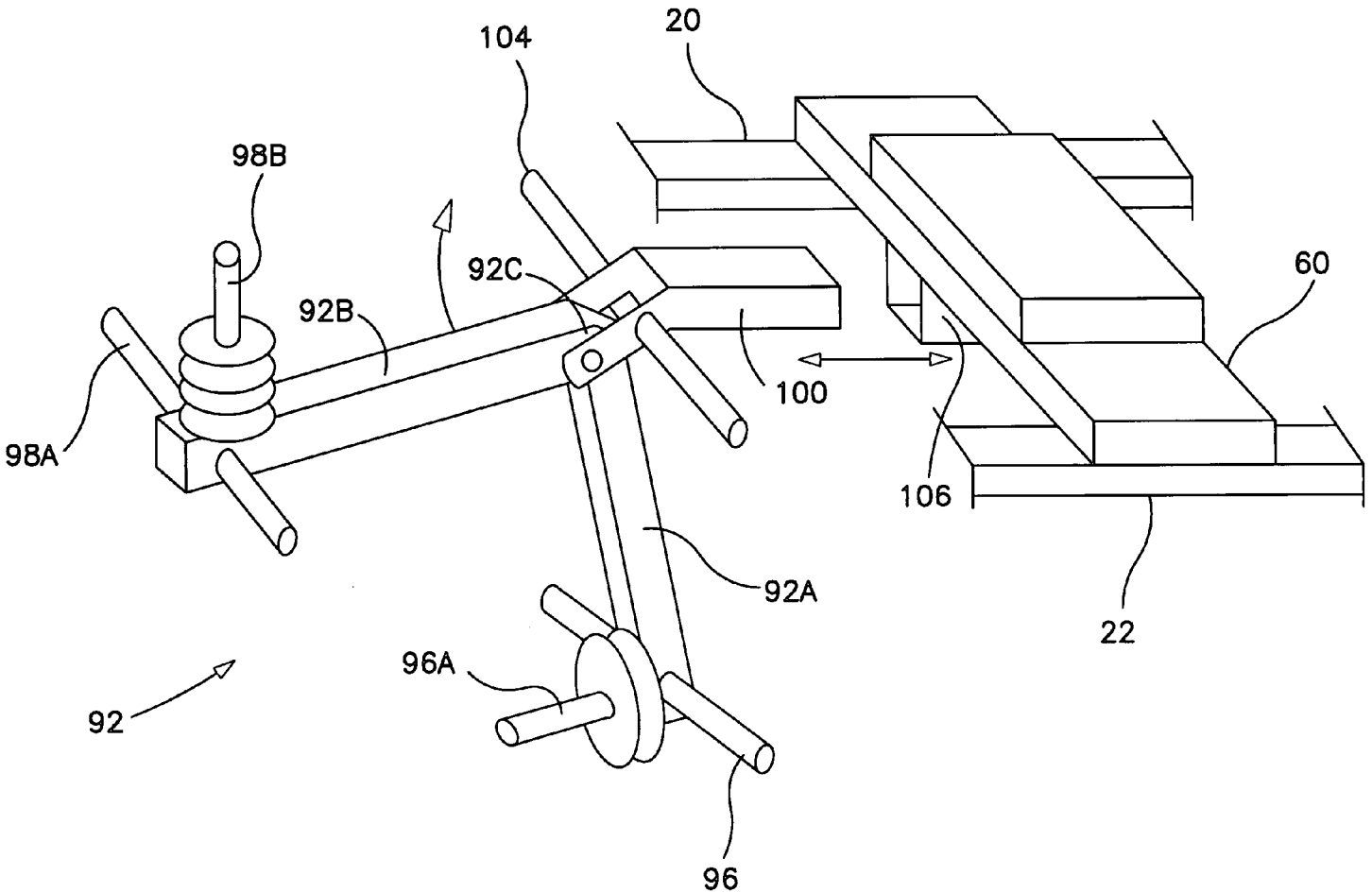
FIG. 6 shows a leg extension fixture 92 that is attachable to the seat for performing knee extensions and leg curls.

FIG. 6 shows a leg extension fixture 92 that is attachable to the seat 60 (FIG. 5A) for performing knee extensions and leg curls. The leg extension fixture 92 comprises a tubular "L" member that has an upper leg 92B and a lower leg 92A. Legs 92A, B are joined perpendicularly to one another at an apex 92C. Lower leg 92A has a toe bar 96 and a toe weight bar 96A secured on its free end. Upper leg 92B has a heel bar 98 A and a heel weight bar 98B secured on its free end. A padded knee support bar 104 is shown secured perpendicular to the "L member at the apex 92C.

A union bar 100 has one end hingeably attached to the apex 92C of the "L" member 92. FIG. 5A, B show a union tube 106 attached to the bottom side of the seat 60. The leg extension fixture is mounted on the seat 60 by telescoping the union bar 100 into the union tube 106.

To perform knee extensions or leg curls, the leg extension fixture 92 is engaged with the seat 60 as described above. Suitable weights are mounted on the toe weight bar 96A and the heel weight bar 98B.

To perform knee extensions, the user sits on the seat 60, engages his toe with the toe bar 96 and straightens his leg.

To perform leg curls, the user lays face down on the seat 60, engages his heel with the heel bar 98 and "curls" his leg (bends his knee)

A major advantage of the leg extension feature of this invention is that by appropriately selecting weights for the toe weight bar 96A and the heel weight bar 98B, the resistance as a function of the bend of the knee can be controlled. This feature is important for developing sprinters.

FIG. 2 shows a vertical floor weight bar 13 having one end secured to a channel 15 Weights 11 are stacked on vertical weight bar 13. The channel 15 is dimensioned for slidably positioning on floor bar 41. Exercises are performed by pulling on one end of strap 17 whose other end is attached to floor bar 41 thereby lifting weight stack 11.

This arrangement enables an athlete to perform exercises that safely strengthen the back, The athlete is supported face down with his hips on the seat and his heels hooked to the handles 46A,B that have been attached at an elevated position on the rear frame legs 16, 18. He bends his back to grasp the free end of the floor strap 17 (see FIG. 2) whose other end is secured to the floor bar 41, He performs the exercise for the back by pulling on the floor strap 17 to lift the free end of the floor bar 41 off the floor. In one variation for performing the exercise, the strap is looped around the athlete's head so that the major muscle group is the upper back. In another method, the athlete grasps the floor strap 17 in his hands.

According to an arrangement for performing situps, the user sits on the seat with his toes 60 engaged with the handlebars 46 oriented to point toward one another as illustrated by 46B in FIG. 1. An "upper body" barbell 64 is supported on the front end of the top rails, 20, 22. He lifts and holds the upper body barbell 64 up to his shoulders and performs situps while supported on seat 60.

The upperbody barbell 64 is tethered to the cross bar by a strap 67 having one secured to upper body barbell 64. The strap 67 provides a limit to how far back the user bends to perform the situp. Selecting the appropriate length of the tether is important for preventing strain to the lower back (and particularly damage to the disks of the back) which can occur when the user otherwise performs a situp wherein he leans too far back in performing the situp.

Figure 7:
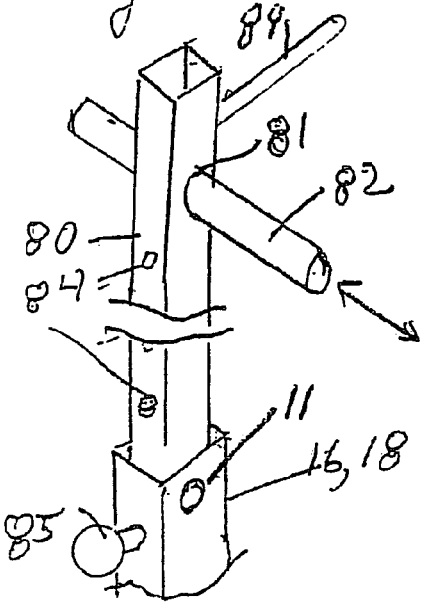
FIG. 7 shows details of the pullup legs

FIG. 2 shows a pair of pullup legs 80 poised for telescoping into the open top ends of rear frame legs 16 and 18. Details of the pullup legs are shown in FIG. 7. The top end of each pullup leg 80 has an aperture 81 through which a pullup bar 82 is slideably positioned (One pullup bar 82 for each pullup leg 80). A row of apertures 84 are shown on each pullup leg 80. A popit pin 85 mounted on each rear fame leg 16, 18 engages a selected one of the apertures 84 thereby supporting the pullup bars 82 at a vertical location depending on the size of the user and whether he wishes to perform pullups or dips.

To perform pullups, the user positions the pullup legs 80 to where the pullup bars 82 are at an over head location. The pullup bars 82 are slid close to one another. The user reaches up and grasps a pullup bar 82, one in each hand and performs the pullups.

To perform dips, the user positions the pullup legs 80 by engaging popit pin 85 with selected aperture 84 (FIG. 7) to where the pullup bars 82 are at chest height. The pullup bars 82 are slid to where the user can step between the ends of pullup bars 82, grasp a pullup bar 82 in each hand, and push himself off the floor to perform the dip.

A squat pin 89 is shown in the top end of each pullup leg 80 which are used as a weight rack to support a free bar bell (not shown) when it is desired to perform exercises such as squats with free weights.

Figure 8:
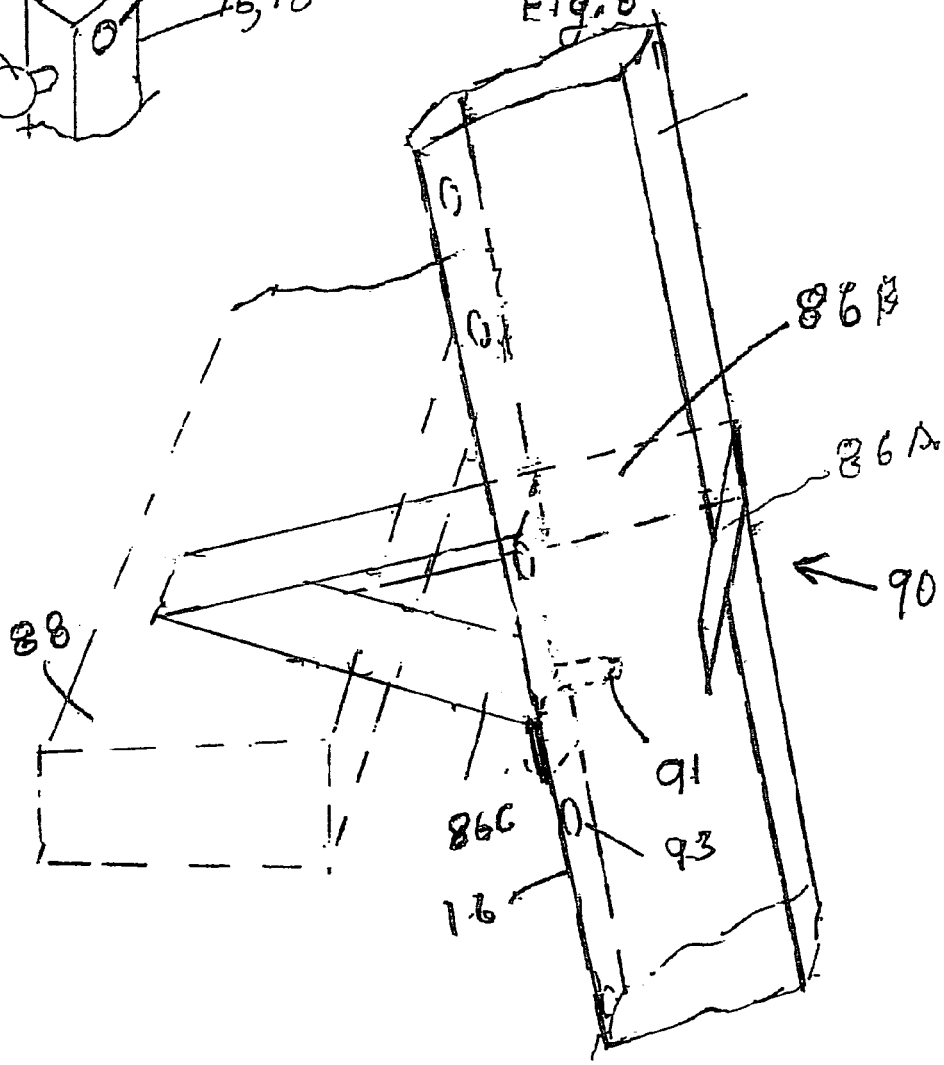
FIG. 8 shows details of the angle brackets that engage selected apertures in the respective rear frame leg.
Figure 9:
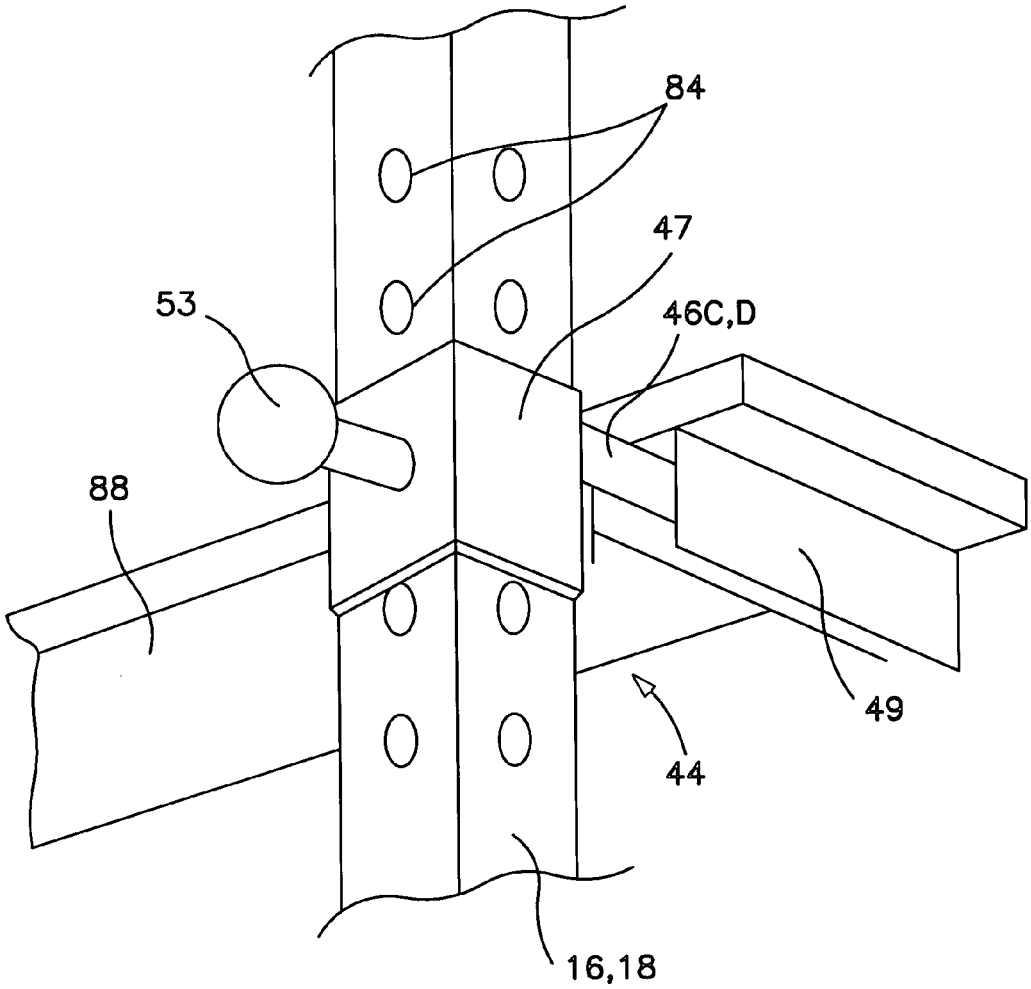
FIG. 9 shows another embodiment for mounting the jump platform.

FIGS. 1, 2 and especially FIG. 9 show a jump platform 88 which is layable across handles 46C, and 46D attachable to apertures 89 in the rear frame legs 16, 18 at selected vertical locations. The jump platform 88 (shown to best advantage in FIG. 8) is thereby supported at the selected vertical location permitting the user to jump onto and off of the platform. A very effective (jumping) plyometric exercise is where the user stands on the platform holding onto rear frame legs 16, 18. Then he drops off the platform and lands on the ground on one leg then immediately leaps back onto the platform (still holding onto the rear legs 26, 28 for balance) This is a very important exercise for developing the high vertical leap that is characteristic of world class sprinters (Vertical jumps off boxes is a popular exercise.) The advantage of using this invention to perform one leg jumps is that the impulse of dropping from a height onto one leg is equal to the impulse on one leg of dropping four times the height onto both legs. Holding onto the vertical legs while performing the jump enables the athlete to balance himself on the one leg. Another advantage using the apparatus is that the athlete can conveniently increase his jump height in 1 and ½ inch increments by simply moving the supporting handles as his jumps ability improves.

FIG. 8 shows an alternative arrangement for supporting the jump platform. The platform 88 is attached to a pair of brackets 90 (only one bracket is shown in FIG. 8. The bracket 90 comprises three members:

a hook 86A that engages the leg 16;

a platform support 86B;

an oblique support 86C with a stud 91 engaging a selected aperture 93 in vertical leg 16.

Figure 10:
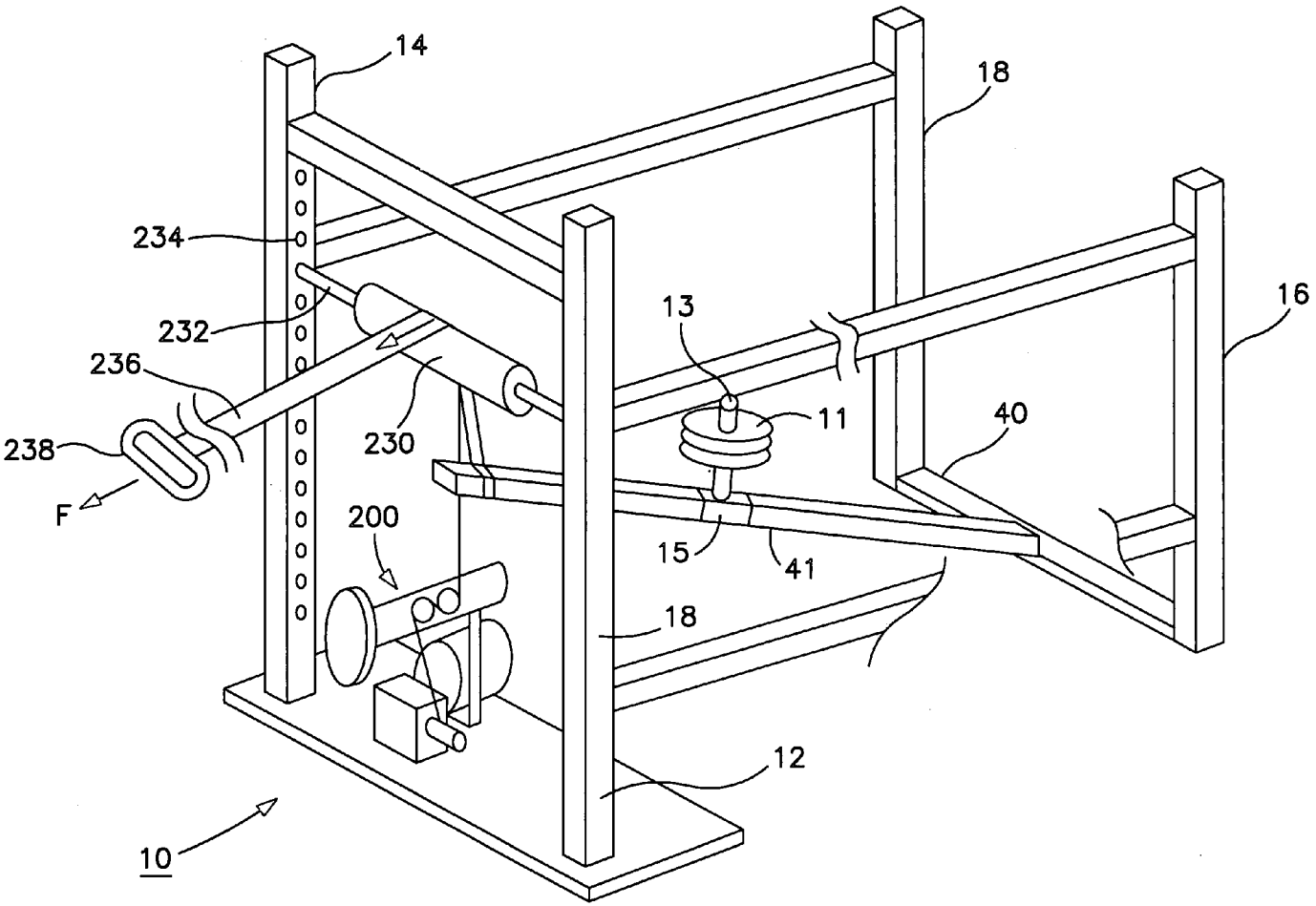
FIG. 10 shows the speed controller coupled for upper body exercises.

FIG. 10 shows another arrangement of the apparatus of FIG. 1, 2 for performing exercises for the upper body. There is shown a bar 230 journalese onto a shaft 232 whose ends are engaged in a selected pair of openings 234 in legs 12, and 14. Bar 230 is conveniently removable when required for other exercises. A strap 236 having one end secured to handle 238 has another end partially wrapped over bar 230 and is secured to an end of floor bar 41. One end of floor bar 41 is perpendicularly joined to the middle of cross floor bar 40 (Platform 42 shown in FIG. 1 has optionally been removed for this mode of exercise.)

In the mode of exercise of FIG. 10, the athlete stands at the end of the apparatus 10 adjacent legs 12 and 14, grasps and pulls the handle 238 thereby lifting one end of floor bar 41. Resistance is provided by weight stack 11 mounted onto weight bar 13 that is vertically mounted on sleeve 15. Sleeve 15 is slideably postionable on floor bar 41 which is another means for adjusting the resistance of the exercise.

An important inherent characteristic in performing this exercise is that the speed of return of the floorbar 41 toward the floor (the negative contraction part of the exercise) is dependent on the location of the weight stack 11 on the floor bar 41. For example, if the stack 11 is at midpoint of the floor bar 41, then the speed of return experienced by the athlete will be twice the free fall of gravity. This is very important for athletes such as baseball players who are desirous of developing plyometric (explosive) strength. The effectiveness of a plyometric exercise increases with the speed of negative contraction that occurs to initiate the forward contraction.

Figure 11B:
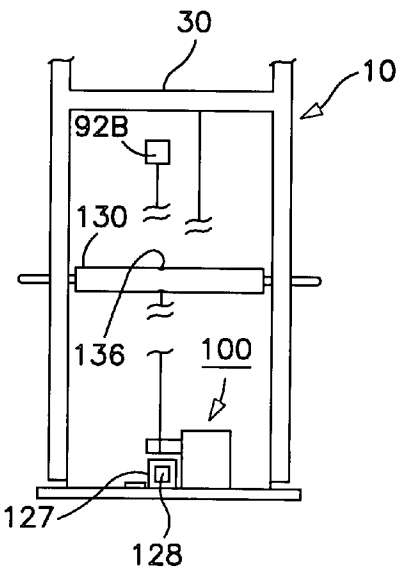
FIG. 11B shows points of attachment of the speed controller to the apparatus.
Figure 11A:
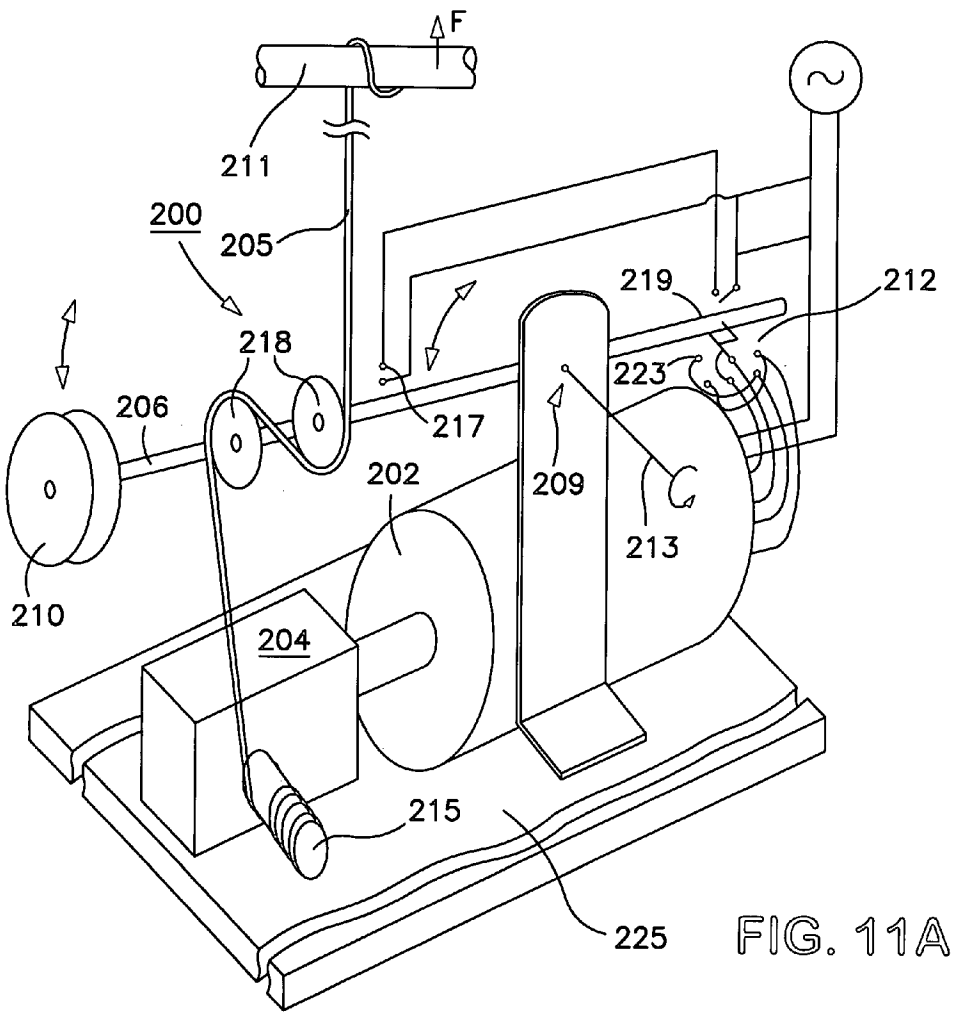
FIG. 11A shows details of the speed controller.

FIGS. 10, 11A and 11B show an important embodiment of this invention being a speed controller" 200 adapted to the apparatus 10 to control the speed of contraction of the exercise. The "speed controller" of this invention is force sensitive in that it will allow the contraction to occur only when the force of the contraction (exerted by the athlete) exceeds a preset value.

FIG. 11A shows the speed controller 200 to best advantage comprising a reversible motor 202 coupled to a speed reducer 204. A lever 206 is shown pivoting about a location 209 close to one end of the lever and a selectable weight 210 located on the other end of the lever 206.

A cable 205 has a distal end attachable at any one of several locations 211 of the apparatus of FIG. 1 Selection of the location 211 depends on the exercise to be performed. The locations are discussed below and illustrated in FIGS. 1 and 11B.

The other end of the cable 205 winds around two pulleys 213 mounted on lever 206 and is then secured to a capstan 215 of the speed reducer 204. The stop/start and direction of rotation of the motor 202 is controlled by the rotational position of the lever 206 relative to three switches. Two switches 217 and 219 are connected in parallel and the motor will run only when either one of the switches 217, 219 is closed. Switch 212 is a double pole double throw switch connected to turn the motor 202 in a "wind" direction when the switch 212 is in one position and connected to turn the motor in an "unwind" direction when the switch 212 is in the other position.

When the force on the cable 205 exceeds the force set by the resistance bar 211 plus the weight 210 on the lever 210, the lever 206 is rotated to an up position where switch 217 is closed so that the motor 202 turns on.

When the lever 206 is oriented completely down (which occurs when there is no force exerted by the cable 209 sufficient to overcome the weight 210 on the end of the lever) then the lever will rotate down and close the second switch 219 and turn on the motor. When the weight 210 on lever 206 is below some position intermediate between up and down, reversing switch 212 connects motor leads such that when the motor turns on (switch 219 closes) the motor will turn in a direction to wind the cable on the capstan 215 (The capstan takes up slack in the cable 109 as the athlete lowers bar 211.)

When the weight 110 on lever 106 is above the position intermediate between up and down, the motor leads are connected such that when the motor turns on (switch 117 closes) the motor will turn in a direction to unwind the cable on the capstan.

Consider that the speed controller cable is coupled to the resistance bar 211 (a part of the apparatus 10 of FIG. 1) and a force of F pounds is required to move the resistance bar. The weight 110 on the controller 100 is selected to require a weight w to lift the lever 106. Then in order for the athlete to move the resistance bar 211 (to perform a repetition), he must apply a force of at least (F+w) to allow the motor 202 to unwind the cable 209. This permits the athlete to lift the resistance bar 211 at the speed permitted by the motor 102.

If the athlete relaxes so that the cable goes slack, then the lever 106 will drop down, the direction control switch 212 will reverse, the second switch 219 will close and the motor will turn in the "wind" direction to take up the slack in the cable. When the capstan 204 has completed taking up the slack, the lever 206 will be pulled to an intermediate position where neither switch 217 and 219 are closed so that the capstan 215 is motionless.

FIGS. 10 and 11B show the apparatus 10 with the controller 200 arranged to connect to various parts of the apparatus 10 and operate with all modes of exercise discussed above.

In FIG. 10, the apparatus is connected to the following parts of the apparatus:

the cross bar 30 shown in FIG. 1 for performing "superslow" deadlifts, leg presses, etc.;

the upper leg 92B (this is an end view of leg 92B, see FIG. 6) for performing knee extensions, leg curls;

strap 136 (see FIG. 11B) for performing upper body exercises.

An important embodiment of this invention is the adaptation of the apparatus to performing "athletic rating tests" (ART). The object of these tests is to measure the strength of the athlete in various ranges of motion that are important for determining athletic performance. A useful test must be performed with the athlete exerting maximum force with specific muscle groups in a manner that avoids injury to the muscle group.

FIG. 1 shows three scales 21 A, B, C, positioned respectively under the front frame legs 12, 14 and floor platform 42 for performing such tests for various muscle groups in important ranges of motion. To perform the tests, the weight bar 23 and floor weight bar 13 are loaded with weight and moved to locations on the lower rails 16, 18 and floor bar 41 respectively where the resistance to performing the one leg knee press, one leg dead lift, one leg back extension, one leg situp is greater than the maximum capacity of the athlete.

He therefore can only perform isometric exercises during which, the force of his pull is observed on the scales.

To measure the strength of each glute (muscles of the buttocks) the athlete stands on one foot on floor platform 42. He bends over so that his knee is approaching his chest and grasps the weight handles 46A, B. Then he pulls on the weight handles with a force that is measured by the change of weight indicated by scales 21A, B.

To measure strength of the quadricep of each leg, the athlete sits on the handles with the handles 46 attached to the front frame legs and oriented as shown by handle 46B in FIG. 1 (handles 46 perpendicular to the floor bar 41). One foot is placed on the floor platform 42. He grasps both handles and pulls on the handles by attempting to straighten his knee. The force exerted by his knee is measured by the change in reading of the scales 21 A, B.

To measure the strength of the hamstring of each leg, the athlete is supported face down on the seat 60 and hooks his heel onto an end of a strap whose other end is attached to the floor bar. Force of the pull on the floor bar is indicated by the change of reading of the scale 21C (FIG. 1).

Similar tests can be performed to measure strength of the leg bicep, hamstring, knee extensors, calves, etc. by supporting the athlete on the seat 60 positioned on the top rails, 20, 22, and pulling with the heel or ankle linked by a strap to the floor bar 41.

All of these exercises—the one leg deadlift, leg press, back extension are very safe permitting the athlete to perform his maximum exertion without injury to the athlete.

It should be noted that important exercises can be performed with the invention that cannot be performed with any other apparatus known to the author. Consider the following examples supporting this statement:

1.) The one legged vertical drop—which is feasible because the athlete can maintain balance by holding onto the vertical legs, and further, where the athlete can increase his drop height in small increments, and further, where the athlete has four times the impulse on one leg than he would experience dropping four times the height on both legs.

2.) The one legged deadlift where the athlete is conveniently enabled to maintain his balance even though he is lifting with only one leg Δn extremely important advantage of the exercise is that the athlete protects Hs back while isolating on his gluteus—the most powerful muscle in the body. The speed of return in the negative contractual phase of the exercise is a multiple of free fall simply beaus of the position of the bar on the horizontal rails relative to the hands.

3.) The ability to reposition the handles very conveniently permits exercising with a weight designed to improve strength in important ranges of motion. For example, the athlete can perform a one legged deadliest starting with the handles 46 A, B and thereby isolate on the glutes. Alternatively, the athlete can relocate the handles and perform a very shallow deadlift thereby isolating on the knee extensors.

Important features of this invention is the arrangement of:

(a) a frame with two front frame legs and two vertical rear frame legs;

(b) attachment of handles at selected vertical locations on the two vertical front frame legs and on the two vertical rear frame legs permitting that different exercises can be performed depending on where the handles are attached and the orientation of the handle perpendicular to or parallel to the floor bar;

selecting a range of motion by selecting a vertical location of the handles so that strength can be increased in that specific range of motion, (d) a platform 42 on a floor bar 41 whose other end is hingeably attached to the lower ends of the rear frame legs;

(e) a lower pair of rails connecting the front frame legs to the rear frame legs;

(f) a barbell supported at a selected location on the pair of lower rails thereby providing an apparatus for performing heavy deadliest and leg presses in a safe manner and convenient means for changing resistance by simply rolling the bar on the rails;

(g) a seat that is mountable on the top rails in a nonslideable mode;

(h) a seat that is mountable on the top rails in a rollable mode which, together with a row handle attachment to a floor bar permits performance of rowing exercises.

(i) legs supporting handles at selectable vertical locations for performing dips or pullups where separation of the handles can be selected to accommodate the size of the athlete;

(j) bar and chain attachment to the apparatus for performing exercises to improve balance by minimizing horizontal inertia when performing the exercise.

(k) means for controlling speed of repetition thereby performing super slow repetitions well known to maximize rate of strength increase.

An important consideration of these features is that numerous novel exercises can be performed that have not been contemplated for apparatuses of the exercise apparatus art and that isolate on specific muscle groups in important ranges of motion.

Various modifications of the invention may be contemplated after reading the specification and studying the drawings which are within the scope of the invention. I therefore wish to define the scope of my invention by the appended claims.

I claim:

1. An apparatus for performing exercises which comprises:

a pair of frames, each frame including:

a.) a pair of front frame legs (12, 14);

b) a pair of rear frame legs (16, 18);

c) a pair of lower rails (24, 26);

one (24) of said lower rails having one end joined perpendicularly to said one of said rear frame legs (16) and an opposite end joined perpendicularly to said one of said front frame legs (12);

another one (26) of said lower rails (26) having one end joined perpendicularly to another one of said rear frame legs (18) and an opposite end joined perpendicularly to said another one of said front frame legs (14);

an H frame (28);

a pair of gripping means (44A,B) for grasping said apparatus, one said gripping means (44A) detachably attached to one of said front frame legs (12) and another gripping means (44B) detachably attached to another one of said front frame legs (14);

each said gripping means including a channel snuggly slideable onto a respective front leg and a popit pin mounted on said channel engageable with any slected aperture in said respective front leg;

said H frame having one end attached to an end of one of said front legs (12) and another end attached to an end of said another front leg (16);

a supporting means (40, 41, 42) comprising a floor bar positioned between said front and rear legs having a platform on one end between said front legs and another end hingeably joined to lower ends of said rear legs for enabling a user to stand on said platform, grasp said handles (44A,B), and lift said front legs (12,14) of said frame;

a barbell (23) supported at a selectable location on said pair of lower rails (24, 26) whereby resistance to lifting said front legs is selectable.

2. The apparatus of claim 1 wherein said H frame includes a cross bar and a pair of stud bars, said cross bar having one end perpendicularly attached to one stud bar and another end attached perpendiclarly attached to to another stud bar;

each said stud bar arranged to telescope onto a top end of one of said front legs, respectively;

each said stud bar having a row of apertures(36);

a pair of spring loaded popit pins, one of said spring loaded popit pins (38) mounted on an upper end of said front leg (12, 16) respectively arranged to engage a selected aperture (36) of a respective stud bar (32,34) whereby vertical distnce of the cross bar (30) from a lower end of said front legs (12,14) is selectable.

3. The apparatus of claim 1 comprising means for releasably clamping said barbell to said lower rails at said selected location.

4. The apparatus of claim 3 wherein said means for releasably clamping comprises a C-clamp having one jaw being flat and another jaw being a hemicylinder for effective clamping action against said bar.

5. The apparatus of claim 1 which comprises:

an exercise bar (54) having one end attached by one chain (56A) to a free end of one gripping means (46 A) and another end by another chain (56 B) to the free end of said other gripping means (46B);

each said chain (46A,B) having a length selected to permit said user to stand on said platform (42) grasp said exercise bar (54) and lift a front end of said apparatus to perform upper body exercises.

6. The device of claim 1 which comprises:

a pair of upper rails (20, 22), each upper rail being parallel to one another;

one (20) of said upper rails (20) having one end joined perpendicularly to one of said rear frame legs (16) and an opposite end joined perpendicularly to one of said front frame legs (12);

another one (22) of said upper rails having one end joined perpendicularly to another one of said rear frame legs (18) and an opposite end joined perpendicularly to another one of said front frame legs 14.

7. The apparatus of claim 6 which comprises:

a seat (60) supported on said upper rails (20, 22);

said seat (60) having one area of support (66) with a surface means for avoiding slipping of said seat on said rails when a user is sitting on said seat to perform exercises.

8. The apparatus of claim 7 wherein said surface means (64) comprises a pair of corrugated rubber trips laminated to an underside of said seat (60) and which interfaces with a top surface of the top rails 20, 24).

9. The apparatus of claim 8 comprising an upperbody barbell (64) supported on a front end of said top rails (20,22) comprising an upper body barbell 64 and accessible to a user sitting on said seat with toes of said user engaged with said handle bars oriented to point toward one another and enabling said user to lift and hold said upper body barbell (64) up to his shoulders to perform situps.

10. The apparatus of claim 9 which comprises a tether having one end secured to said upper body barbell and the other end secured to said cross bar of said H frame;

said tether providing a limit to how far back the user bends to perform said situps while said user holds said one end.

11. The apparatus of claim 8 comprising:

bearing means (69) on another area of said underside of said seat (60) for enabling said seat to roll on said top rails (20, 22):

a row handle (68);

a bearing (72) centrally mounted on said cross bar (30);

a pulley (73) mounted on said floor bar (41);

a row strap (70) having one end attached to said row handle (68) and another end passing over a bearing (72) centrally mounted on said cross bar (30), said row strap then passing around said pulley (73) and back to where another end of said strap (70) is fastened to said cross bar (30);

a stack of row weights (78);

a means for holding said stack of row weights (78) on said floor bar (41).

12. The apparatus of claim 11 wherein said means for holding said stack of row weights (78) comprises:

a channel slidably straddling said floor bar;

a post (74) having one end mounted on said channel (76)

weights mounted on said post (74) whereby resistance is provided to perform said rowing exercise.

13. The apparatus of claim 8 which comprises:

a tubular "L" member (92) that has an upper leg (92A) and a lower leg (92B) attached perpendicularly to one another at an apex (92C);

a toe bar (96) and a toe weight bar (96A) secured on a free end of lower leg (92A);

a heel bar (98A) and a heel weight bar (98B) secured on a free end of lower leg (92B);

a padded knee support bar (104) secured perpendicularly to said apex (92C) of said L member at the apex (92C);

a union bar (100) having one end hingeably attached to said apex (92C) of said L member (92);

a union tube means (106) secured to said under surface of said seat dimensioned for telescoping said union bar 100 into said union tube 106 permitting a user to perform knee extensions with weights mounted on said toe weight bar and said heel weight bar.

14. The apparatus of claim 1 which comprises:

a pair of pullup legs (80) one of said pullup legs detachably telescoped into an open top end of one of said rear frame legs (16) and another one of said pullup legs detachably telescoped into an open top end of another one of said rear frame legs (18)

a hole (81) through a top end of each pullup leg;

one pullup bar (82) slideably positioned in said hole in said one pullup leg;

another pullup bar (82) slideably positioned in said hole in said another pullup leg;

a row of apertures (84) in each pullup leg (80);

a pair of spring loaded pins (85);

one of said pins mounted on one rear fame leg (16); and another one of said pins mounted on said another rear frame leg (118);

each said spring loaded pin engaging a selected aperture (84) of said row of apertures in said respective rear frame leg whereby each said pullup bars (82) is supported at a vertical location selected by the user according to the size of the user and whether he wishes to perform pullups or dips and wherein separation between said pullup bars is selected according to size of said user positioned between said pullup bars.

15. The apparatus of claim 1 which comprises:

a jump platform (88);

means for detachably attaching said jump platform at selected vertical locations to a pair of legs, said pair of legs being any of:

(a) said rear frame legs (16, 18);

(b) said front frame legs (12, 14).

16. The apparatus of claim 15 wherein said means for detachably attaching said jump platform at selected vertical locations on said pair of legs comprises:

a pair of handles (44A,B);

each handle (44A,B) including:

(i) a channel (47) mounted slideably onto one of said legs;

(ii) each said leg (12,16) having a front row of apertures (50) on one side of said front leg (12,16) and a side row of apertures 52 on another side adjacent said one side;

(iii) a spring loaded pin (53) mounted on said channel (47) engaging a selected one of said apertures (50,52) to detachably secure the handle (44A,B) at a selected vertical location on said frame leg (12,16) wherein said spring loaded pin (52) is engaged with an aperture of said row of apertures and said handle bar is parallel to said floor bar permitting that said jump platform (88) be supported on said handles (44A,B).

17. The apparatus of claim 1 which comprises a scale means (21A,B) for measuring weight supported by at least one of said front frame legs (12, 16).

18. The apparatus of claim 1 which further comprises:

each said rear leg (16,18) having a front row of apertures (81) on one side of said rear leg (16,18); and each said rear leg (16,18) having a side row of apertures (83) on another side adjacent said one side and facing said other rear leg;

said handle bar (44A,B) attachable to said rear leg (16,18) in any one of a selected orientation parallel to said floor bar (41) and a selected orientation perpendicular to said floor bar.

19. The apparatus of claim 18 which comprises a jump platform (88) detachably mountable on said handles (46 C,D), said handles detachably attached to said rear frame legs when said handles are oriented parallel to said floor bar (41) and extending in a rearward direction away from said apparatus.

20. The apparatus of claim 1 comprising a row of indicia (25) inscribed on at least one of said pair of lower rails (22) where each indicia represents resistance to said exercise when said barbell is located adjacent said each indicia.

21. An apparatus for performing exercises which comprises:

a pair of front frame legs (12, 14);

a pair of rear frame legs (16, 18);

a pair of lower rails (24, 26);

one (24) of said lower rails having one end joined perpendicularly to said one of said rear frame legs (16) and an opposite end joined perpendicularly to said one of said front frame legs (12);

another one (26) of said lower rails (26) having one end joined perpendicularly to another one of said rear frame legs (18) and an opposite end joined perpendicularly to said another one of said front frame legs (14);

an H frame (28) including a cross bar (30) having an end perpendicularly attached to one stud bar (32) and another end perpendicularly attached to another stud bar 34;

said stud bar (32) telescoped into a top open end of said front leg 12 and said another stud bar 34 telescoped into the top end of front leg (16);

a row of apertures 36 in the stud bars 32 and 34;

a spring loaded popit pin 38 in each upper ends of front legs 12, and 16) arranged to permit that vertical distance of the cross bar from the ground is selectable;

a barbell;

said barbell supported on said pair of lower rails (24, 26) whereby resistance to performing said leg press and said deadlift is selected by rolling said barbell on said lower rails to a selected location corresponding to said selected resistance;

a row of indicia (25) inscribed on at least one rail (24,26) of said pair of lower rails wherein each indicia represents resistance to said lifting said front legs (12,14) when said barbell (23) is located adjacent said each indicia;

a pair of C-clamps, each having one jaw being flat and another jaw being a hemicylinder for clamping said bar to a respective one of said lower rails (22);

a pair of handle bars(46);

a channel (47) for each said handle bar (46) that slides onto said respective front frame leg (12,14);

each said front leg (12, 16) having a front row of apertures (50) on one side of said front leg 12, 16, and a side row of apertures 52 on another side adjacent said one side;

a spring loaded pin mounted on said channel (47) operably arranged to engage a selected one of said apertures (50, 52) in an operable arrangement to detachably secure the handle at a selected vertical location on said front frame leg permitting each said handle bar to be oriented in any one of two directions wherein one said direction is both handles are aligned with one another and another one of said directions is both handles being parallel to said rails and pointing away from said apparatus;

a cross floor bar (40) having one end rotatably pinned to a bottom end of said rear leg (14);

said cross floor bar (40) having another end rotatably pinned to the bottom end of said rear leg (18);

a floor bar (41) having one end secured perpendicularly to said cross floor bar (40) midway between ends of said cross bar (40);

said floor bar (41) having another end extending horizontally to between and beyond said pair of front frame legs front legs (12, 14);

a platform (42) secured to said another end of floor bar (41) and extending between and beyond said pair of front frame legs;

said pair of handles, pair of front frame legs, pair of rear frame legs, said platform means, said H frame, all arranged in operable combination to enable a user to stand on said platform (42), facing the apparatus, grasp said handle (46A,B) and lift said front legs (12,14) of said apparatus;

an exercise bar (54) having one end attached by one chain (56A) to a free end of one handle bar (46 A) and by another chain (56 B) to the free end of said other handle bar (46B);

each said chain (46A,B) having a length selected to permit said user to perform upperbody exercises by standing on said platform, grasping said exercise bar (54) and lifting an end of said apparatus;

a pair of upper rails (20, 22);

one (20) of said upper rails (20) having one end joined perpendicularly to one of said rear frame legs (16) and an opposite end joined perpendicularly to one of said front frame legs (12);

another one (22) of said upper rails having one end joined perpendicularly to another one of said rear frame legs (18) and an opposite end joined perpendicularly to another one of said front frame legs 14;

a seat (60) supported on said upper rails (20, 22);

said seat (60) having a pair of corrugated rubber strips (64) laminated to an underside of said seat (64) and which interfaces with a top surface of each top rail (20, 24) to avoid slipping of said seat on said rails when a user is sitting on said seat to perform exercises;

an upper body barbell 64 supported on a front end of said top rails (20, 22) and permitting a user to sit with toes of said user engaged with said handle bars (46A,B) oriented perpendicular to said rails (22) and enabling said user to lift and hold said upper body barbell (64) up to his shoulders to perform situps;

a tether having one end secured to said upper body barbell and the other end secured to said cross bar of said H frame;

said tether providing a limit to how far back the user bends to perform said situps;

a channel slidably straddling said floor bar;

a pair of pullup legs (80) one of said pullup legs telescoped into an open top end of one of said rear frame legs (16) and another one of said pullup legs detachably telescoped into an open top end of another one of said rear frame legs (18);

a hole (81) through a top end of each pullup leg(80);

one pullup bar (82) slideably positioned in said hole (81) in said one pullup leg (80);

another pullup bar (82) slideably positioned in said hole (81) in said another pullup leg (80);

a row of apertures (84) in each pullup leg (80);

a pair of spring loaded pins (85), one of said pins mounted on one rear frame leg (16); and another one of said pins (85) mounted on said another rear frame leg (18);

each said spring loaded pin arranged to engage a selected aperture (84) of said row of apertures in said respective rear frame leg (18, 16) whereby each said pullup bars (82) is supported at a vertical location depending on the size of the user and whether he wishes to perform pullups or dips;

a scale means for measuring weight under at least one of said front frame legs providing that force applied by a user standing on said platform is registered on said scale;

each said rear leg (16,18) having a front row of apertures (81) on one side of said rear leg (16, 18) and a side row of apertures (83) on another side adjacent said one side providing that said handle bar (44A,B) is attachable to said rear leg in any one of a selected orientation parallel to said floor bar (41) and a selected orientation perpendicular to said floor bar (41);

a jump platform (88) detachably positioned on said handles (44A,B);

said handles(44A,B) detachably attached to said rear frame legs (16A,B);

said handles (44A,B) oriented parallel to said floor bar (41) and extending in a rearward direction away from said apparatus.

22. The apparatus of claim 21 further comprising a speed controller means (200) to control speed of performing an exercise on said apparatus.

23. The apparatus of claim 22 wherein said speed controller comprises:

a base (225);

a capstan (215);

a reversible motor (202) arranged to drive said capstan (215);

a lever (206) having an axis of rotation (214) and mounted on said base (225);

a selectable weight (210) positioned on an end of said lever (206) opposite said axis of rotation (214);

a pair of pulleys (214) mounted on said lever (206) between said weight and said axis of rotation;

a cable (205) having one end attached to said exercise apparatus (10) and another end coupled to said capstan (215);

said cable having a section engaging said pair of pulleys (213) and rotating said lever (206) in a lift direction when said cable is pulled with sufficient force to lift said selectable weight (210) on said lever (206);

a lift switch (217) connecting said reversible motor to a source of power;

said lift switch coupled to said lever (206) to close when said lever is rotated in said lift direction and exceeds a first preset value;

a relax switch means (219) connecting said motor (204) to said source of power and coupled to said lever (206) to close when force applied by said cable to said lever is less than a second preset value;

a reversing switch means (212) coupled to said lever and connected to said motor (204) for turning said capstan in an unwind direction when force applied to said cable has a value between said first preset value and said second preset value.

* * * * *